US008002720B2

(12) United States Patent
Hansen et al.

(10) Patent No.: US 8,002,720 B2
(45) Date of Patent: Aug. 23, 2011

(54) SUPPORT FOR CHEST COMPRESSION SYSTEM

(75) Inventors: Frederik Hansen, Stavanger (NO); Øyvind Tjølsen, Stavanger (NO)

(73) Assignee: Laerdal Medical AS, Stavanger (NO)

( * ) Notice: Subject to any disclaimer, the term of this patent is extended or adjusted under 35 U.S.C. 154(b) by 1342 days.

(21) Appl. No.: 11/584,256

(22) Filed: Oct. 20, 2006

(65) Prior Publication Data

US 2008/0097261 A1 Apr. 24, 2008

(51) Int. Cl.
*A61H 31/00* (2006.01)
*A61H 23/00* (2006.01)

(52) U.S. Cl. ..... 601/41; 601/107

(58) Field of Classification Search ..... 601/41, 601/42, 43, 44, 107; 128/204.18, 204.21
See application file for complete search history.

(56) References Cited

U.S. PATENT DOCUMENTS

| | | | | |
|---|---|---|---|---|
| 3,425,409 | A | 2/1969 | Isaacson et al. | 128/28 |
| 3,489,140 | A | 1/1970 | Mullikin | 128/51 |
| 3,782,371 | A | 1/1974 | Derouineau | 128/28 |
| 4,237,872 | A | 12/1980 | Harrigan | 128/24 R |
| 4,273,114 | A | 6/1981 | Barkalow et al. | |
| 4,632,094 | A | 12/1986 | Thomas | 128/52 |
| 5,327,887 | A * | 7/1994 | Nowakowski | 601/41 |
| 5,490,820 | A | 2/1996 | Schock et al. | |
| 5,496,257 | A | 3/1996 | Kelly | |
| 5,571,142 | A | 11/1996 | Brown et al. | |
| 5,743,864 | A | 4/1998 | Baldwin, II | 601/41 |
| 5,823,185 | A | 10/1998 | Chang | |
| 5,833,711 | A | 11/1998 | Schneider, Sr. | |
| 6,090,056 | A | 7/2000 | Bystrom | |
| 6,171,267 | B1 | 1/2001 | Baldwin, II | |
| 6,224,562 | B1 | 5/2001 | Lurie et al. | |
| 6,312,399 | B1 | 11/2001 | Lurie et al. | |
| 6,398,745 | B1 | 6/2002 | Sherman et al. | 601/41 |
| 6,807,442 | B1 | 10/2004 | Myklebust et al. | |
| 6,827,695 | B2 | 12/2004 | Palazzolo et al. | |
| 7,226,427 | B2 | 6/2007 | Steen | |
| 7,569,021 | B2 | 8/2009 | Sebelius et al. | |
| 2002/0165471 | A1 | 11/2002 | Halperin et al. | |
| 2003/0181834 | A1 | 9/2003 | Sebelius et al. | 601/41 |
| 2004/0002667 | A1 | 1/2004 | Sherman et al. | |
| 2004/0039313 | A1 | 2/2004 | Sherman et al. | |
| 2004/0162587 | A1 | 8/2004 | Hampton et al. | |

(Continued)

FOREIGN PATENT DOCUMENTS

| | | |
|---|---|---|
| GB | 527048 | 10/1940 |

(Continued)

OTHER PUBLICATIONS

Hansen, Federik , "Office Action for U.S. Appl. No. 11/584,256", Feb. 17, 2010.

(Continued)

*Primary Examiner* — Quang D Thanh
(74) *Attorney, Agent, or Firm* — Dorsey & Whitney LLP

(57) ABSTRACT

A support for a chest compression system includes a back plate, a front part having a seat for a compression member of a chest compression system, and a side part connecting the back plate to the front part. The side part is adapted to provide adjustable spacing between the seat and the back plate to accommodate patients having different chest heights to allow the support to be snugly placed around the chest of a patient.

19 Claims, 3 Drawing Sheets

U.S. PATENT DOCUMENTS

| | | | |
|---|---|---|---|
| 2004/0230140 | A1 | 11/2004 | Steen |
| 2005/0137628 | A1 | 6/2005 | Young et al. |
| 2006/0084892 | A1 | 4/2006 | Lenhart et al. |
| 2006/0089574 | A1 | 4/2006 | Paradis |
| 2006/0155222 | A1 | 7/2006 | Sherman et al. |
| 2008/0097257 | A1 | 4/2008 | Stromsnes |
| 2008/0097534 | A1 | 4/2008 | Myklebust et al. |

FOREIGN PATENT DOCUMENTS

| | | |
|---|---|---|
| WO | WO-9959673 | 11/1999 |
| WO | WO-2004073580 | 9/2004 |
| WO | WO-2006088373 | 8/2006 |

OTHER PUBLICATIONS

Myklebust, Helge , "Office Action for U.S. Appl. No. 11/584,257", May 11, 2009.

Myklebust, Helge , "Office Action for U.S. Appl. No. 11/584,257", Nov. 24, 2009.

Stromsnes, Oystein , "Office Action for U.S. Appl. No. 11/584,243", Sep. 25, 2009.

Vessela, Krasteva et al., "Assessment of ECG Frequency and Morphology Parameters for Automatic Classification of Life-Threatening Cardiam Arrhythmias", *Institute of Physics Publishing. Meas. 26*, 2005 , 707-723.

* cited by examiner

SUPPORT FOR CHEST COMPRESSION SYSTEM

TECHNICAL FIELD

This invention is related to resuscitation systems, and more particularly to a support device for a chest compression system and a chest compression system provided with such a support.

BACKGROUND OF THE INVENTION

Sudden cardiac arrest is a leading cause of death in developed countries in the Western World, like the United States and Canada. To increase the chance for survival from cardiac arrest, important aspects are CPR (Cardio Pulmonary Resuscitation) and heart defibrillation given in the first few critical minutes after the incident. CPR is performed to ensure a sufficient flow of oxygenated blood to vital organs by external compression of the chest combined with rescue breathing. Heart defibrillation is performed to re-establish normal heart rhythm by delivery of an external electric shock. The quality of CPR is essential for survival. Chest compressions must be given with a minimum of interruptions, and be of sufficient depth and rate. Performing chest compressions manually is an extremely exhausting task, and it is practically impossible to give manual CPR of sufficient quality during transportation of a patient.

To overcome this problem, a number of chest compression systems for cardiopulmonary resuscitation have been developed. These systems comprise a chest compression member in charge of performing the compressions, and it is necessary to ensure that said member compresses the patient's chest in a correct place. It is also necessary to ensure that the correct positioning is maintained during the resuscitation process.

U.S. Pat. No. 5,743,864 describes a device for automatic mechanical external chest compressions consisting of a vertical column attached to a base plate. A cantilevered arm with a cylinder and piston assembly is connected to an annular collar adapted to surround the patient. The annular collar is formed by a single membrane or by an outer and an inner membrane. The collar does not permit adaptation to different patient sizes and shapes.

U.S. Pat. No. 6,398,745 shows another example of an automatic CPR-device. This device uses a compression belt extending around the chest of a patient. The belt is repetitively tightened and relaxed through the action of a belt-tightening spool powered by an electric motor. The motor is controlled by a control system that times the compressions and controls the compressions through an assembly of clutches and brakes connecting the motor to the belt-tightening spool. The compression belt compresses and decompresses the chest of a patient, but it can easily get caught in the patient's clothes. For this reason the patient must be unclothed before the chest compression procedure can start, and valuable time is lost. The belt also covers a large area of the patient's chest and can thus interfere with defibrillation electrodes. Further, use of this device requires that either the defibrillator electrodes be arranged on the patient prior to the arrangement of the belt or that the belt be removed before defibrillation can take place. The belt also makes use of a stethoscope to check for correct intubation and adequate rise cumbersome.

U.S. patent Publication No. 2003181834 describes another chest compression apparatus. The device comprises a back plate positioned behind the patient's back posterior to the patient's heart. The device also includes a front part for positioning around the patient's chest anterior to the patient's heart. The front part comprises two legs, which can be coupled to the back plate. The front part comprises a compression unit that automatically compresses or decompresses (lifts) the patient's chest. The front part also includes a compression member that can be fastened to the patient's chest by means of a vacuum cup. This vacuum cup will get correctly fixed in some patients but will displace on the chest in other patients leading to incorrect or unstable chest compressions.

The above-mentioned devices are either complicated and time-consuming to apply, cumbersome to install and operate, or are unstable on the chest. They are further heavy and expensive to purchase. There is therefore a need for a support that maintains a chest compression device in a substantially constant position and force direction with respect to a patient's chest, and at the same time can be easily and quickly deployed, and is also rugged, portable and light weight, safe and reliable.

SUMMARY OF THE INVENTION

The invention is directed to a chest compression support having a back plate, a front part carrying a seat for a chest compression device, and side parts connecting the back plate to the front part. The support has an adjustable spacing between the seat and the back plate to accommodate different chest thicknesses. The back plate includes a patient-receiving surface having lateral limits defined by the side parts. However, the lateral positions of the side parts may be moved to adjust the size of the patient-receiving surface to ensure that most patients, regardless of their size, will be limited in their lateral movement by the side part. The side parts may be in the form telescopic lockable legs having a length adjustable to the patient's chest thickness. Hinges may also be used in the side parts to provide an adjustable length.

DETAILED DESCRIPTION OF PREFERRED EMBODIMENTS

Figure 1:
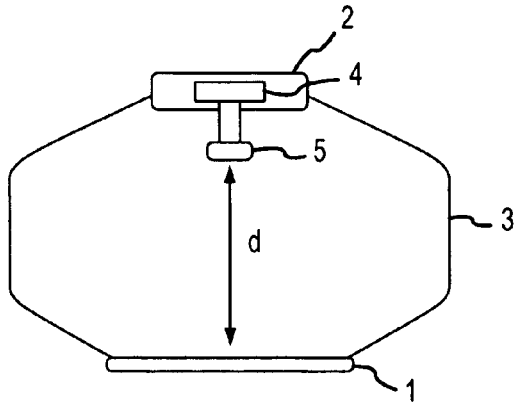
FIG. 1 is a schematic diagram of one embodiment of the invention.

FIG. 1 is a schematic diagram showing a chest compression system support according to one embodiment of the invention. The support includes a back plate 1, a front part 2 and a side part 3. The front part 2 includes a seat 4 for a compression member 5. The side part 3 can be coupled to the back plate 1 and to the front part 2 and is adapted to provide an adjustable distance d between the seat 4 and the back plate 1.

Figure 2:
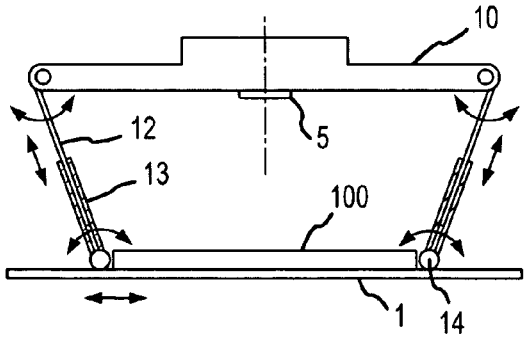
FIG. 2 is a cross-sectional view of a first embodiment of the invention in a deployed position.

FIG. 2 shows a first embodiment of the invention. In this embodiment of the invention the front part comprises a transverse plate 10 where the chest compression system is situated. The chest compression system comprises in this embodiment of the invention a chest compression member 5 in the form of a piston, a transmission mechanism for transmitting energy to the piston, a motor, and a power supply (not shown). Part of the chest compression system may be situated externally to the support, and the support may be mechanically attached to the compression member 5.

In this embodiment of the invention, the transverse plate 10 is substantially rectangular and is coupled on its short edges to two lateral legs. Each of the legs is formed an upper part 12 and a lower part 13. The upper part 12 is hinged to the transverse plate 10 and is also situated telescopically inside the lower part 13. This arrangement permits easy adaptation of the legs' length to the patient's chest height. The devices for locking the legs at the wanted length are conventional and are therefore not shown in the Figure. The lower edge of the lower part 13 is connected to the back plate 1 adapted for placement under the patient's back and defines a patient-receiving surface 100. The lower parts 13 of the legs can be fixed or rotatably connected to the back plate 1. In one embodiment of the invention, the legs are rotatably and slidably connected to the back plate 1 by hinges 14. The term "hinges" as used herein relates to any element that permit at least rotational connection between two parts, and the elements can also permit slidable connection. The hinges 14 permit the legs to rotate towards the transverse plate 10 to provide a storage position for the chest compression system and the support. The legs are adapted for abutment against the sides of the patient's body. In an embodiment of the invention the adjustable area of the patient receiving surface is provided by the side part being slidably connected to the back plate. This can be achieved by providing one or more slides and protrusions in the back plate and in the side part. The slides can have transversal recesses with circular cross-sections to permit rotation of the side parts. This permits displacement of the lower edge of the side part (e.g. legs) on the back plate 1 to situate the lower edges against the patient's body and thus provide stability in the chest compression. Once the side parts are slid into position, they can be locked. Locking of the side parts can be performed by means of locking devices or e.g. by providing slides with separated locking positions (notches).

It is also possible for the side parts to be rotatable and not slidably fastened to the back plate 1. Rotation of the side parts to a position near the patient's side will provide the wanted limitation of the patient's lateral movement. A rotatable coupling can be provided during the manufacturing process if the side part (e.g. in the form of legs) is integrated to the back plate 1 or by elements (e.g. hinges) situated between the side parts and the back plate 1 if the back plate 1 and side parts are separate elements.

The chest compression system support is used by placing the support on the patient by first situating the back plate 1 under the patient's back. The front part is then placed over the patient, and the back plate is then coupled to the front part by means of the side parts. The lower edges of the side parts will be laterally displaced until they comes into contact with the patient or are situated at a desired distance from the patient's sides. Once the sides have been placed in their correct positions, they will be locked in position. In one embodiment of the invention, the legs are locked in position using an adhesive or a high friction material on the lower ends of the legs to permit secure positioning on the patient's body. Finally, the seat of the compression member will be lowered until it is situated at the desired distance from the patient's chest and locked into position. It is also possible to change the order of the above-mentioned steps e.g. by positioning the seat in the correct distance before displacing the legs towards the patient.

The support according to the various embodiments of the invention ensures that the compression member exerts a force on a determined place on the patient's body and in a determined direction. This place corresponds to the lower sternum and the direction is substantially perpendicular to the patient's chest surface. The support according to one embodiment of the invention is symmetric in relation to an axis longitudinal to the patient to provide further precision. The support thus inherently positions the patient in the proper location. The positioning of the support relative to the patient's length may be facilitated by means of illustrations on the support or by other display devices, by means of straps, etc. In an embodiment of the invention the seat comprises fastening devices for the compression member, which fastening devices ensure that the compression force has a direction substantially perpendicular to the patient's chest. In an embodiment of the invention the compression member is integrated in the seat and the seat is attached to the front part in a manner which ensures that the compression force has a direction substantially perpendicular to the patient's chest The chest compression system mounted on the transverse plate 10 may be any system suitable for compressing the chest of a patient, such as pneumatic, hydraulic or electric actuated pistons, bladders, etc. The chest compression member may be fixed to the patient's chest by means of fastening devices such as tape, or by vacuum. Alternatively, the chest compression member can be merely in contact with the chest without being fastened to the chest. In one embodiment, the seat 4 for the compression member comprises a transverse plate, which is arranged substantially parallel to the back plate 1 when the support is deployed. In this way, the support forms a quadrangle around the patient.

The support may be collapsible, demountable or foldable in order to minimize volume of the system when not in use. Preferably, the support is easy to assemble and prepare for use, in order to minimize time wasted on assembling and mounting.

Figure 3:
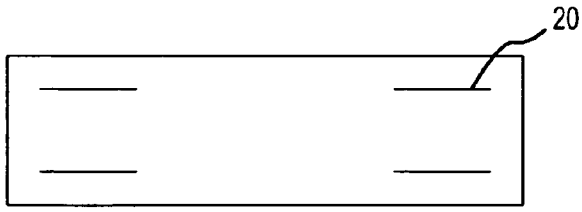
FIG. 3 is a plan view of the back plate in the first embodiment of the invention.

FIG. 3 shows a back plate 1, which, in this embodiment of the invention, is provided with coupling devices or slides 20 that permit displacement of the lower edges of the legs on the back plate 1. These coupling devices or slides 20 permit displacement of the lower edge of part 13 towards the patient to adjust the area of the patient receiving surface to the patient's size. It is also possible to provide a single slide for each leg. In this embodiment of the invention, the assembly formed by the front plate 10 and the legs 12, 13 provides a first section of the support, and the back plate provides a second section of the support.

Figure 4:
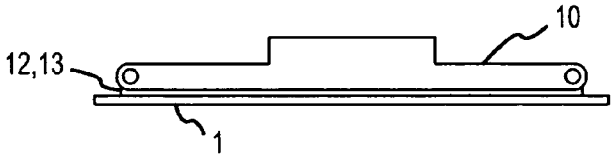
FIG. 4 is an elevational view of said first embodiment of the invention in a folded position.

FIG. 4 shows the support according to another embodiment of the invention in a folded storage position. The legs 12, 13 are reduced telescopically in length, and the transverse plate 10 with the chest compression system is situated adjacent to the legs. The back plate 1 is situated under the first element comprising transverse plate 1 and the legs 12, 13. The support can be packed in a bag of suitable dimensions. The back plate 1 may be situated on top of the first element so that the back plate 1 is available for the operator when the bag is opened. The back plate 1 is used by placing it under the patient, and the first part is grasped by handles (not shown) to rotate the legs 12, 13 away from the transverse plate 10 either by means of spring devices or by gravity or by a combination of these. The legs 12, 13 will also expand to their full length. This movement can be controlled, e.g., by release mechanisms in connection with the handles. Finally, the first element is placed over the patient, coupled to the back plate 1 and adjusted to the patient's size.

In an embodiment of the invention (not shown) the upper and lower part 12, 13 of the legs can be separated to provide two separate elements, one being the transverse plate 10 with the above mentioned devices on it and one being the lower part of the legs 13 and the back plate 1. The separate parts can be folded to a flat position, permitting easy storage of the device.

Figure 5:
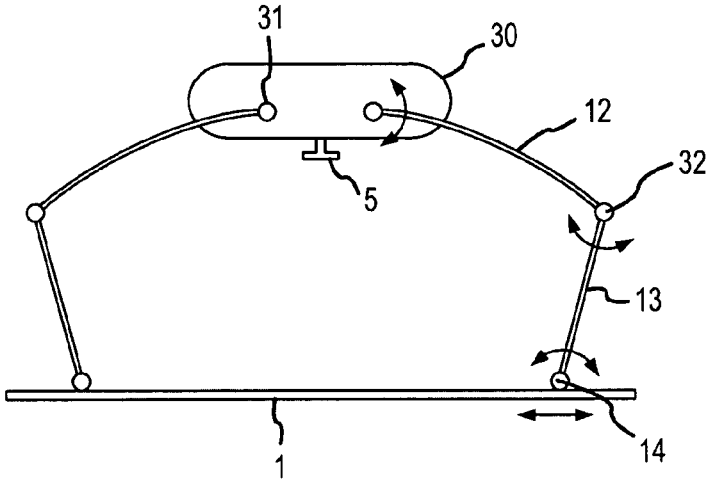
FIG. 5 is a cross-sectional view of a second embodiment of the invention in a deployed position.
Figure 6:
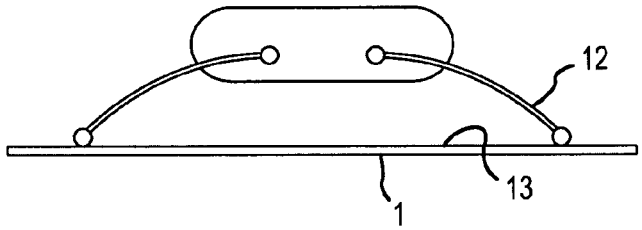
FIG. 6 is a cross-sectional view of the second embodiment of the invention in a folded position.

FIG. 5 shows a second embodiment of the invention. In this embodiment, the chest compression system is situated in a body 30. The upper parts of the legs 12 are rotatably connected to the body 30 by means of hinges 31 or similar devices. Hinges 31 are situated in the vicinity of one another and, in one embodiment of the invention, are interconnected. The upper and lower parts of each leg (12 and 13 respectively) are also rotatably coupled to one another by means of hinges 32. In one embodiment of the invention, the hinges 31 and 32 also provide locking of the body 30 at a determined distance from the back plate 1. The lower part of each leg is rotatably and slidably connected to back plate 1. The chest compression system can be divided into a first and a second element in a manner similar to that described above in relation to FIGS. 1-4.

As mentioned earlier the support according to the various embodiments of the invention can be provided with devices to ensure symmetry with respect to the patient's longitudinal direction during height and width adjustment. These devices can comprise toothed wheels, rods, ribbons, etc.

Figure 7:
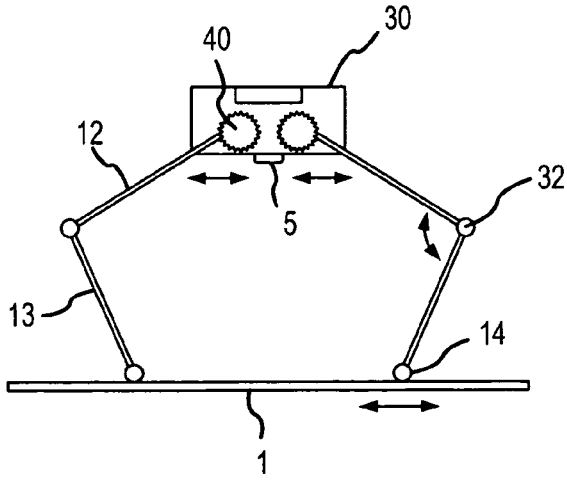
FIG. 7 is a cross-sectional view of a third embodiment of the invention.

FIG. 7 shows a third embodiment of the invention where block 30 includes elements 40 that can rotate and slide. A connection between the lower part of legs 13 and plate 1 permits sliding but rot rotation.

Figure 8:
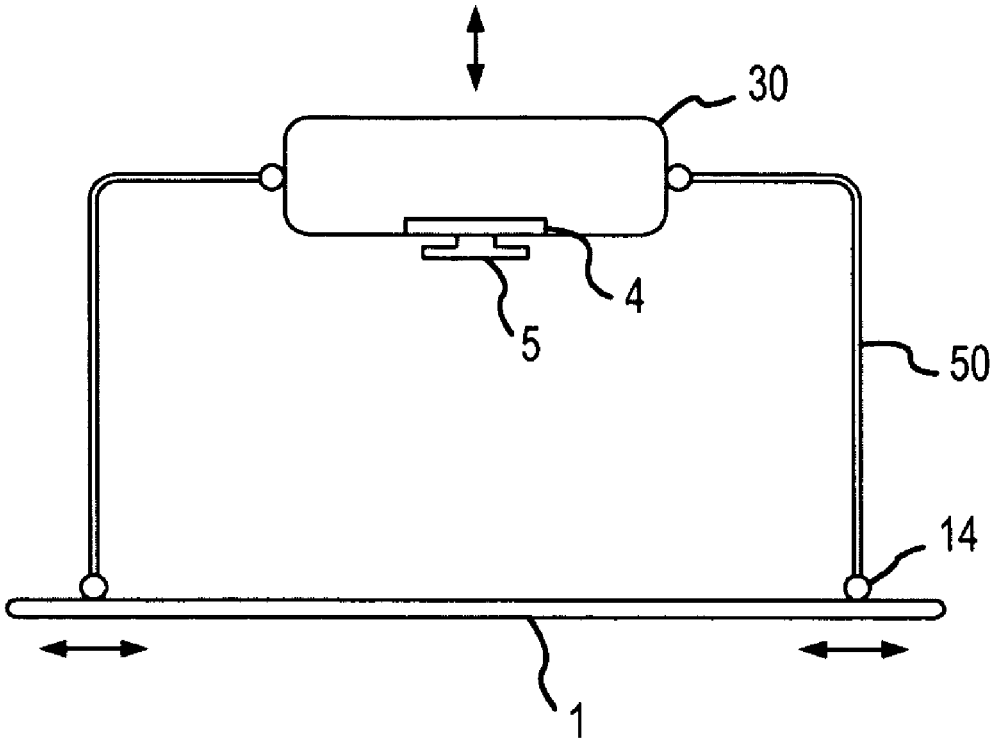
FIG. 8 is a cross-sectional view of a fourth embodiment of the invention.

FIG. 8 shows a fourth embodiment of the invention, where the front part includes a body 30 provided with means for adjusting the distance between seat 4 for the compression member 5 and back plate 1. In this embodiment, legs 50 are inextensible, are slidably connected to back plate 1 and can be locked in different positions to provide an adjustable area for the patient-receiving surface.

From the foregoing it will be appreciated that, although specific embodiments of the invention have been described herein for purposes of illustration, various modifications may be made without deviating from the spirit and scope of the invention. Accordingly, the invention is not limited except as by the appended claims.

What is claimed is:

1. A support for a chest compression system comprising:
a back plate;
a front part having a seat for a compression member; and
a side part connecting the back plate to the front part to form a space therebetween, an end of the side part secured to the back plate and configured to laterally slide relative to the back plate to adjust the space between the front part and the back plate.

2. The support of claim 1 wherein the back plate includes a patient receiving surface with adjustable area.

3. The support of claim 1 wherein at least one of the side part and the front part comprises devices that are one of rotatable, telescopic and slidable operable to adjust the space between the seat and the back plate.

4. The support of claim 1 wherein the back plate comprises a hinge that permits rotation of the side part in a plane that is substantially perpendicular to a plane defined by a surface of the back plate.

5. The support of claim 1 wherein the side part comprises two legs with adjustable lengths.

6. The support of claim 5 wherein the two legs further comprise elements to ensure that a variation in the length of one leg leads to a similar variation in the length of the other leg.

7. The support of claim 1 wherein the side part comprises legs fastened to the front part and coupling elements for coupling to the back plate.

8. The support of claim 1 wherein the side part comprises legs fastened to the back plate and coupling elements for coupling to the front part.

9. The support of claim 1 wherein the side part comprises legs integrated in the front part and coupling elements for coupling to the back plate.

10. The support of claim 1 wherein the side part comprises legs integrated in the back plate and coupling elements for coupling to the front part.

11. The support of claim 1, further comprising means for ensuring that the compression member exerts a predetermined force in a predetermined place in a predetermined direction.

12. The support of claim 1, further comprising elements for controlling the positioning of the support on the patient in the longitudinal direction.

13. The support of claim 1 wherein the chest compression system comprises pneumatic, hydraulic or electric actuated pistons or bladders.

14. The support of claim 1 wherein the side part is provided with an adhesive or a high friction material on the lower end to permit secure positioning on a patient's body.

15. The support of claim 1, further including means for making the support collapsible, demountable or foldable.

16. The support of claim 1 wherein an end of the side part is rotatably secured to at least one of the front part and the back plate to allow the side part to rotate in a plane that is substantially perpendicular to a plane defined by a surface of the back plate.

17. The support of claim 1 wherein the side part comprises an upper portion and a lower portion, the upper portion rotatably secured to the lower portion.

18. The support of claim 1 wherein the side part comprises a plurality of side parts.

19. The support of claim 1 wherein the side part comprises a locking mechanism that locks the side part in a position relative to the back plate.

* * * * *